US009420895B2

(12) United States Patent
Lafleche et al.

(10) Patent No.: US 9,420,895 B2
(45) Date of Patent: Aug. 23, 2016

(54) PATIENT SUPPORT

(71) Applicant: Stryker Corporation, Kalamazoo, MI (US)

(72) Inventors: Patrick Lafleche, Kalamazoo, MI (US); Stephen F. Peters, Hickory Corners, MI (US); Michael T. Brubaker, Vicksburg, MI (US)

(73) Assignee: Stryker Corporation, Kalamazoo, MI (US)

( * ) Notice: Subject to any disclaimer, the term of this patent is extended or adjusted under 35 U.S.C. 154(b) by 147 days.

(21) Appl. No.: 14/019,353

(22) Filed: Sep. 5, 2013

(65) Prior Publication Data

US 2014/0059780 A1 Mar. 6, 2014

Related U.S. Application Data

(60) Provisional application No. 61/697,010, filed on Sep. 5, 2012.

(51) Int. Cl.

| | |
|---|---|
| ***A47C 27/08*** | (2006.01) |
| ***A47C 27/00*** | (2006.01) |
| ***A47C 21/04*** | (2006.01) |
| ***A61G 7/00*** | (2006.01) |
| ***A47C 31/00*** | (2006.01) |
| ***A61G 7/057*** | (2006.01) |

(52) U.S. Cl.

CPC ..... *A47C 27/081* (2013.01); *A47C 21/044* (2013.01); *A47C 21/046* (2013.01); *A47C 27/001* (2013.01); *A47C 31/00* (2013.01); *A61G 7/001* (2013.01); *A61G 7/05715* (2013.01); *A61G 7/05769* (2013.01); *A61G 2007/05792* (2013.01)

(58) Field of Classification Search

CPC A47C 27/081; A47C 27/082; A47C 27/083; A47C 21/046; A47C 31/001; A47C 27/001; A47C 21/044; A61G 7/05715; A61G 7/05769; A61G 7/001; A61G 2007/05792

See application file for complete search history.

(56) References Cited

U.S. PATENT DOCUMENTS

| | | | | | |
|---|---|---|---|---|---|
| 3,222,697 | A | * | 12/1965 | Scheermesser | 428/160 |
| 3,319,274 | A | * | 5/1967 | Upton | 5/701 |
| 3,742,528 | A | * | 7/1973 | Munch | 5/723 |
| 3,846,857 | A | * | 11/1974 | Weinstock | 5/727 |
| 4,536,906 | A | * | 8/1985 | Varndell et al. | 5/725 |
| 4,719,656 | A | * | 1/1988 | Godinet | 5/401 |
| 4,843,664 | A | * | 7/1989 | Farnworth et al. | 5/417 |
| 5,027,458 | A | * | 7/1991 | Osczevski et al. | 5/700 |
| 5,546,618 | A | * | 8/1996 | Beedy et al. | 5/725 |

(Continued)

OTHER PUBLICATIONS

PCT International Search Report for Application No. PCT/US2013/058235 filed on Sep. 5, 2013.

(Continued)

*Primary Examiner* — David E Sosnowski
*Assistant Examiner* — Eric Kurilla
(74) *Attorney, Agent, or Firm* — Warner Norcross & Judd LLP

(57) ABSTRACT

A patient support for supporting a patient includes a plurality of cushioning layers arranged such that their supporting surfaces when unloaded are generally arranged in a plane, and with each cushioning layer interlocked with each adjacent cushioning layer wherein each cushioning layer provides lateral and longitudinal support to each of its adjacent cushion layer.

13 Claims, 15 Drawing Sheets

(56) References Cited

U.S. PATENT DOCUMENTS

| | | | | |
|---|---|---|---|---|
| 5,551,107 | A * | 9/1996 | Graebe | 5/654 |
| 5,561,875 | A * | 10/1996 | Graebe | 5/423 |
| 5,623,736 | A * | 4/1997 | Soltani et al. | 5/689 |
| 5,704,084 | A * | 1/1998 | Evans et al. | 5/710 |
| 5,953,779 | A * | 9/1999 | Schwartz | 5/722 |
| 5,966,763 | A * | 10/1999 | Thomas et al. | 5/715 |
| 5,991,949 | A * | 11/1999 | Miller et al. | 5/710 |
| 6,047,424 | A * | 4/2000 | Osborne et al. | 5/713 |
| 6,119,291 | A * | 9/2000 | Osborne et al. | 5/600 |
| 6,223,369 | B1 * | 5/2001 | Maier et al. | 5/713 |
| 6,401,282 | B1 * | 6/2002 | Shum | 5/722 |
| 6,519,797 | B1 * | 2/2003 | Brubaker et al. | 5/654 |
| 6,760,937 | B1 * | 7/2004 | Ou | 5/652.1 |
| 8,108,957 | B2 * | 2/2012 | Richards et al. | 5/600 |
| 2002/0129449 | A1 * | 9/2002 | Harker | 5/726 |
| 2002/0148045 | A1 * | 10/2002 | Giori et al. | 5/709 |
| 2003/0030319 | A1 * | 2/2003 | Clapper | 297/452.41 |
| 2003/0135930 | A1 * | 7/2003 | Varese et al. | 5/727 |
| 2005/0273940 | A1 * | 12/2005 | Petrosenko et al. | 5/722 |
| 2006/0075559 | A1 * | 4/2006 | Skinner et al. | 5/615 |
| 2006/0112489 | A1 * | 6/2006 | Bobey et al. | 5/655.3 |
| 2006/0168736 | A1 * | 8/2006 | Meyer et al. | 5/727 |
| 2007/0000060 | A1 * | 1/2007 | Firestone | 5/659 |
| 2007/0101505 | A1 * | 5/2007 | Oprandi | 5/710 |
| 2007/0157394 | A1 * | 7/2007 | Giggleman | 5/727 |
| 2007/0277320 | A1 * | 12/2007 | Massmann | 5/654 |
| 2008/0028533 | A1 * | 2/2008 | Stacy et al. | 5/713 |
| 2008/0078033 | A1 * | 4/2008 | Wyatt et al. | 5/727 |
| 2008/0148481 | A1 * | 6/2008 | Brykalski et al. | 5/423 |
| 2008/0263763 | A1 * | 10/2008 | Butler | 5/81.1 R |
| 2008/0282471 | A1 * | 11/2008 | Chambers et al. | 5/616 |
| 2009/0013470 | A1 * | 1/2009 | Richards et al. | 5/613 |
| 2009/0013472 | A1 * | 1/2009 | Koffler et al. | 5/652.1 |
| 2009/0183313 | A1 | 7/2009 | Poulos | |
| 2010/0063638 | A1 * | 3/2010 | Skinner | 700/281 |
| 2010/0175196 | A1 | 7/2010 | Lafleche et al. | |
| 2010/0281618 | A1 * | 11/2010 | O'Reagan | 5/709 |
| 2011/0010865 | A1 * | 1/2011 | Flick et al. | 5/690 |
| 2011/0113561 | A1 | 5/2011 | Douglas | |
| 2011/0209289 | A1 | 9/2011 | Meyer et al. | |
| 2011/0289691 | A1 | 12/2011 | Lafleche et al. | |
| 2011/0302720 | A1 * | 12/2011 | Yakam et al. | 5/710 |
| 2012/0186587 | A1 * | 7/2012 | Steffens et al. | 128/845 |
| 2013/0061396 | A1 * | 3/2013 | Lafleche et al. | 5/600 |
| 2013/0067662 | A1 * | 3/2013 | Jusiak et al. | 5/724 |
| 2013/0219626 | A1 * | 8/2013 | Clapper | 5/655.3 |
| 2014/0059781 | A1 * | 3/2014 | Lafleche et al. | 5/713 |
| 2014/0090178 | A1 * | 4/2014 | Morgan et al. | 5/740 |
| 2014/0237722 | A1 * | 8/2014 | Gibson et al. | 5/600 |
| 2014/0237726 | A1 * | 8/2014 | Gibson et al. | 5/691 |
| 2014/0373279 | A1 * | 12/2014 | Lafleche et al. | 5/699 |
| 2015/0013073 | A1 * | 1/2015 | Schwirian et al. | 5/706 |
| 2015/0059100 | A1 * | 3/2015 | Brubaker et al. | 5/710 |
| 2015/0082550 | A1 * | 3/2015 | Hui | 5/727 |
| 2015/0101126 | A1 * | 4/2015 | Reiners et al. | 5/715 |

OTHER PUBLICATIONS

PCT Written Opinion for Application No. PCT/US2013/058235 filed on Sep. 5, 2013.

* cited by examiner

PATIENT SUPPORT

CROSS-REFERENCE TO RELATED APPLICATIONS

This application claims the benefit of U.S. provisional application U.S. provisional application Ser. No. 61/697,010 (P405) filed Sep. 5, 2012, entitled PATIENT SUPPORT, which is incorporated by reference herein in its entirety.

This application is related to U.S. provisional application Ser. No. 61/837,067 (P405A) filed Jun. 19, 2013, entitled PATIENT SUPPORT COVER Ser. No. 61/507,371, filed Jul. 13, 2011, entitled PATIENT/INVALID HANDLING SUPPORT; copending U.S. application Ser. No. 13/548,591, filed Jul. 13, 2012, entitled PATIENT/INVALID HANDLING SUPPORT; U.S. copending application Ser. No. 13/022,326, filed Feb. 7, 2011, entitled PATIENT/INVALID HANDLING SUPPORT; U.S. copending application Ser. No. 13/022,372, filed Feb. 7, 2011, entitled PATIENT/INVALID HANDLING SUPPORT; U.S. copending application Ser. No. 13/022,382, filed Feb. 7, 2011, entitled PATIENT/INVALID HANDLING SUPPORT; U.S. copending application Ser. No. 13/022,454, filed Feb. 7, 2011, entitled PATIENT/INVALID HANDLING SUPPORT; U.S. copending application Ser. No. 12/640,770, filed Dec. 17, 2009, entitled PATIENT SUPPORT; and U.S. copending application Ser. No. 12/640,643, filed Dec. 17, 2009, entitled PATIENT SUPPORT.

TECHNICAL FIELD AND BACKGROUND OF THE INVENTION

The present invention generally relates to a patient support, and more particularly to a patient mattress for a hospital bed.

SUMMARY OF THE INVENTION

The present invention provides a mattress for supporting a patient with one or more cushioning layers that provide immersion and pressure distribution to a patient supported on the mattress.

In one form of the invention, a patient support includes a plurality of cushioning layers arranged such that their supporting surfaces when unloaded are generally arranged in a plane. Each cushioning layer is interlocked with each adjacent cushioning layer wherein each cushioning layer provides lateral and longitudinal support to each of its adjacent cushion layers.

In one aspect, the cushioning layers include a bladder layer.

In another aspect, the cushioning layers include a gel layer.

According to yet another aspect, at least one of the cushioning layers includes transverse openings allowing air to pass through the at least one cushioning layer to direct air flow through the at least one cushioning layer.

In any of the above supports, the patient support may include a plurality of inflatable bladders and a gel layer adjacent the inflatable bladders. For example, the gel layer may interlock with adjacent bladders of the inflatable bladders.

In another aspect, each of the bladders has a hexagonal cross-section. In addition or alternately, the gel layer may include a plurality of hexagonal gel footings. For example, each of the gel footings may be disconnected from its adjacent gel footings. Optionally, each of the gel footings may be internally reinforced by a plurality of hexagonal gel wall structures.

According to yet another aspect, the cushioning layers are supported on a foam crib.

In addition, the support optionally includes turning bladders positioned below the foam crib, with the foam crib including at least two hinged panels to allow turning of a patient supported on the patient support.

In another aspect, the support includes a cover and is configured to flow air through the support beneath the cover to manage moisture that may build up under the cover, which is formed from a material that prevents liquid intrusion but allows gas and moisture to flow through the cover.

For example, the foam crib may include a plurality of channels extending there through for directing air through the foam crib and into at least one of the cushioning layers. Additionally, the foam crib may support or house one or more blowers to direct air though the channels.

In another aspect, the support cover includes a mesh panel that permits air to be drawn into the cover by the blower units.

Accordingly, the present invention provides a support surface that provides a patient with pressure distribution and optionally improved moisture management.

Before the embodiments of the invention are explained in more detail below, it is to be understood that the invention is not limited to the details of operation or to the details of construction and the arrangement of the components set forth in the following description or illustrated in the drawings. The invention may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE PREFERRED EMBODIMENT

Figure 1:
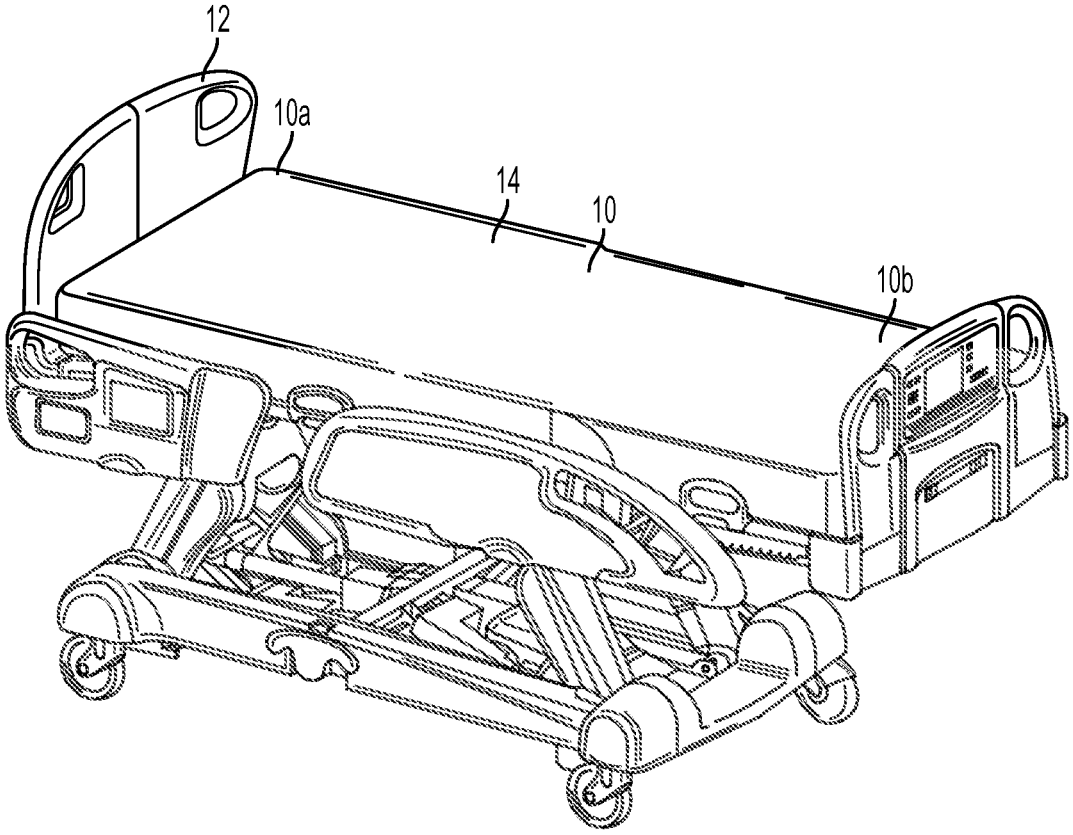
FIG. 1 is a perspective view a patient support shown mounted to a patient support apparatus, for example, a hospital bed.

Referring to FIG. 1, the numeral 10 generally designates a patient support of the present invention. While described as a "patient" support, it should be understood that "patient" is to be construed broadly to include not only people undergoing medical treatment but also invalids and other persons, such as long term care persons, who may or may not be undergoing medical treatment. Further, while patient support 10 is illustrated as a mattress, it will be understood that patient support 10 may take on other forms, such as pads, cushions, including cushions for a wheelchair or a stationary chair pads. As will be more fully described below, patient support 10 provides support to a patient's body and, further, may be adapted to provide therapy or treatment to the patient, for example, rotation therapy, percussion therapy, or vibration therapy or the like. Additionally, the support surface of the patient support may be configured to provide a control system that automatically determines a suitable immersion level for each individual patient that is positioned on the support, thereby creating an individualized immersion level that is tailored to that specific individual. For further details of a suitable immersion control system reference is made to copending application U.S. Ser. No. 61/696,819, filed Sep. 5, 2012, entitled INFLATABLE MATTRESS AND CONTROL METHODS, which is incorporated by reference herein in its entirety.

Referring again to FIG. 1, patient support 10 is supported on a patient support apparatus 12 that, in this particular embodiment, is a hospital bed. However, patient support apparatus 12 may take on other forms besides a hospital beds, such as, but not limited to, long term care, cots, stretchers, operating tables, gurneys, and the like. Further, patient support apparatus 12 may be a conventional support apparatus that is commercially available and that merely provides a supporting function for patient support 10.

For example, patient support apparatus 12 may include one or more controls that are integrated therein and which are used in controlling one or more functions of patient support 10, as will be discussed in greater detail below. For example, electrical connectors may be provided for establishing an electrical link between a user interface that is positioned on, or integrated into, the barrier of patient support apparatus 12. The user interface may take on a variety of different forms, such as, but not limited to, a touch screen, a Liquid Crystal Display (LCD), a plurality of buttons, switches, knobs, or the like, or any combination of these components, which allows a user to control the operation of patient support 10. The connection between the interface and patient support 10 may take on different forms, including a direct electrical cable that runs from the footboard to patient support 10, for example by way of electrical connectors that electrically couple the user interface to circuitry supported on or in the frame of the bed, and/or by wireless communication, such as disclosed in commonly assigned, U.S. patent application Ser. No. 13/802,855, filed Mar. 14, 2013, by applicants Michael Hayes et al. and entitled COMMUNICATION SYSTEMS FOR PATIENT SUPPORT APPARATUSES, the complete disclosure of which is hereby incorporated herein by reference. For more exemplary details of a suitable hospital bed reference is made to the beds described in U.S. Pat. Nos. 8,006,332; 7,690,059; 7,805,784; 7,962,981; and 7,861,334, all commonly owned by Stryker Corporation of Kalamazoo, Mich., which are herein incorporated by reference in their entireties.

Figure 2:
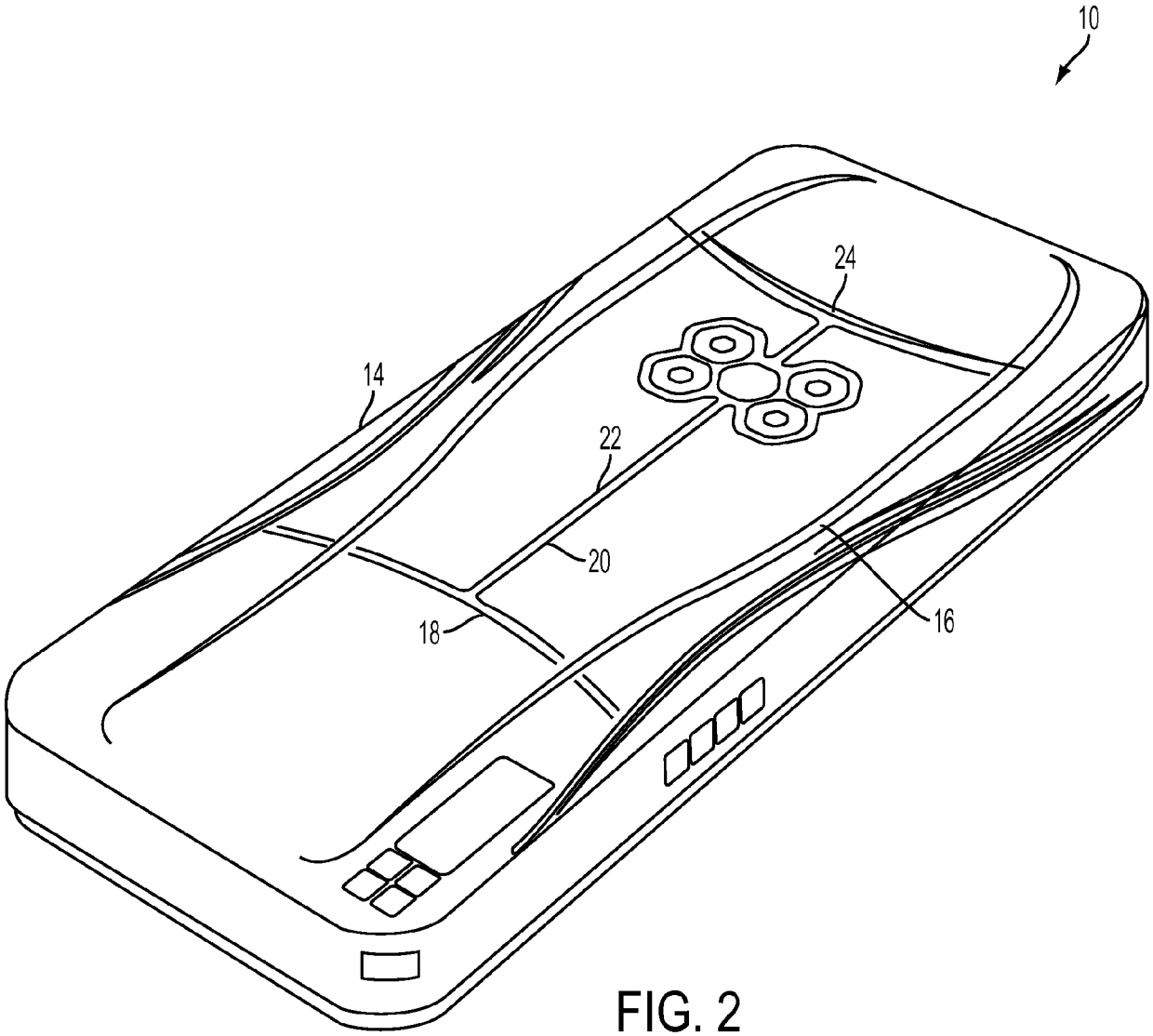
FIG. 2 is a perspective view of the patient support of FIG. 1.

Referring to FIG. 2, patient support 10 includes a cover 14, which provides a plurality of optional features. For example, cover 14 may be formed from a flexible knit material, such as a flexible knit nylon or a nylon-like fabric, which provides a high breathability rate to facilitate moisture management. Additionally, cover 14 may be formed with the knit fibers on the patient facing side of the cover and with an inner surface formed by a stretchy elastomeric membrane that is stretchable so as not to reduce, if not eliminate, any interference with the patient immersion into support 10, as will be more fully described below. Furthermore, as will be more full described below, because cover 14 optionally encloses one or more blowers or fans for circulating air through the support, as part of a low air loss system, cover 14 may incorporate an open mesh panel to allow air to be drawn into the cover 14.

In another aspect, cover 14 may include one or more indicia on its surface. For example, cover 14 may include indicia to define the preferred location for a patient on patient support 10. The indicia may include a demarcation 16, such as a line, that defines the overall general area in which the patient should be positioned in the supine position and additional demarcations 18, 20, 22, and 24, also for example lines, that define the foot area, the thigh and seat areas, the back areas, and the head area of the patient support. In this manner, when a patient is located in the general area and also generally aligned with the sub-areas, the patient will be properly aligned with the support cushioning layers and turning bladders that are configured to provide the appropriate cushioning and functionality to that region of the patient's body.

In addition to the demarcation lines that identify the different areas/sections of the support, other indicia may be applied for example, graphical instructions, representations of the underlying cushioning layers (e.g. the gel or bladders), as well as the location of optional percussion/vibration and/or turning bladders to again facilitate the proper positioning of the patient.

The various demarcations, which for example indicate the different areas of support, i.e. thigh and back support areas, foot support areas, and head support areas, may be applied to the underlying sheet that forms the cover using a heat transfer process. For example, ink that is applied to a carrier sheet may be transferred onto the fabric that forms the cover using heat. In this manner, the ink does not simply coat the fabric, as is the case with silk screening, and instead merges with the fabric (and optionally underlying elastomeric membrane) which provides the sheet with generally constant properties. This tends to reduce the wear and provide increased longevity to the demarcations.

To provide appropriate cushioning and immersion for the patient, patient support 10 includes a bladder layer 26 with a plurality of bladders 26*a*, 26*b*, which provide support to the patient's thighs, seat, back, and head, and a gel layer 28, which provides support to the patient's heels. Bladder layer 26 may be formed from a sheet of gelatinous elastomeric material, which is configured, such as by molding, including injection molding, blow molding, thermoforming, or cast molding, to include a plurality of sacs or cavities, which form upper wall 26*c* and side walls 26*d* of each bladder 26*a*, 26*b*, which is then joined with a bottom sheet 26*e* to form the closed chambers of the bladders (see FIG. 4A). The two sheets are joined together around their respective perimeters and around each of the sacs to form an array of discrete bladders. At least some regions of the sheets may be left un-joined (for example see in FIG. 4A) to form fluid passageways between some or all of the adjacent bladders so that a network of passageways can be formed in the bladder layer to allow air flow between at least some of the bladders, which reduces the amount of tubing that is require to inflate the bladders and to maintain the pressure in the bladders at the desired pressure value. As noted below, some bladders may be grouped together in that they are in communication with each other through the above-noted air passageways, or through tubing, so that the bladders form zones.

Referring to FIG. 2, bladder layer 26 and gel layer 28 are supported so that their top or patient facing surfaces are adjacent each other and positioned generally in the same plane and at the same height (when not loaded with a patient) to form a generally continuous layer of cushioning. Though as noted below, at the interface between the gel layer and the bladders layer, the gel layer may be slightly angled downwardly to provide a more comfortable transition between the adjacent cushion layers.

In the illustrated embodiment, bladders 26*a*, 26*b* are arranged in zones, which optionally may be independently controlled with the inflation/deflation of each zone independent of the other zone or zones. For example, the zones may include a head zone at the head end 10*a* of support 10, a back zone at the back section 10*c* of support 10, seat and thigh zones at the seat and thigh sections 10*d*, and a heel zone at the foot end 10*b* of patient support 10. Further, each zone may be divided, for example into a left sub-zone and a right sub-zone so that when a patient is being turned, the pressure on the bladders on one side may be adjusted (e.g. increased or decreased) to accommodate the motion of the patient. For example, in the illustrated embodiment, the seat zone includes a right seat zone and a left seat zone to facilitate turning the patient. In the illustrated embodiment, the back zone and the head zone are grouped together and, further, positioned so that they will generally be aligned together when the patient is positioned on support 10

Figure 3:
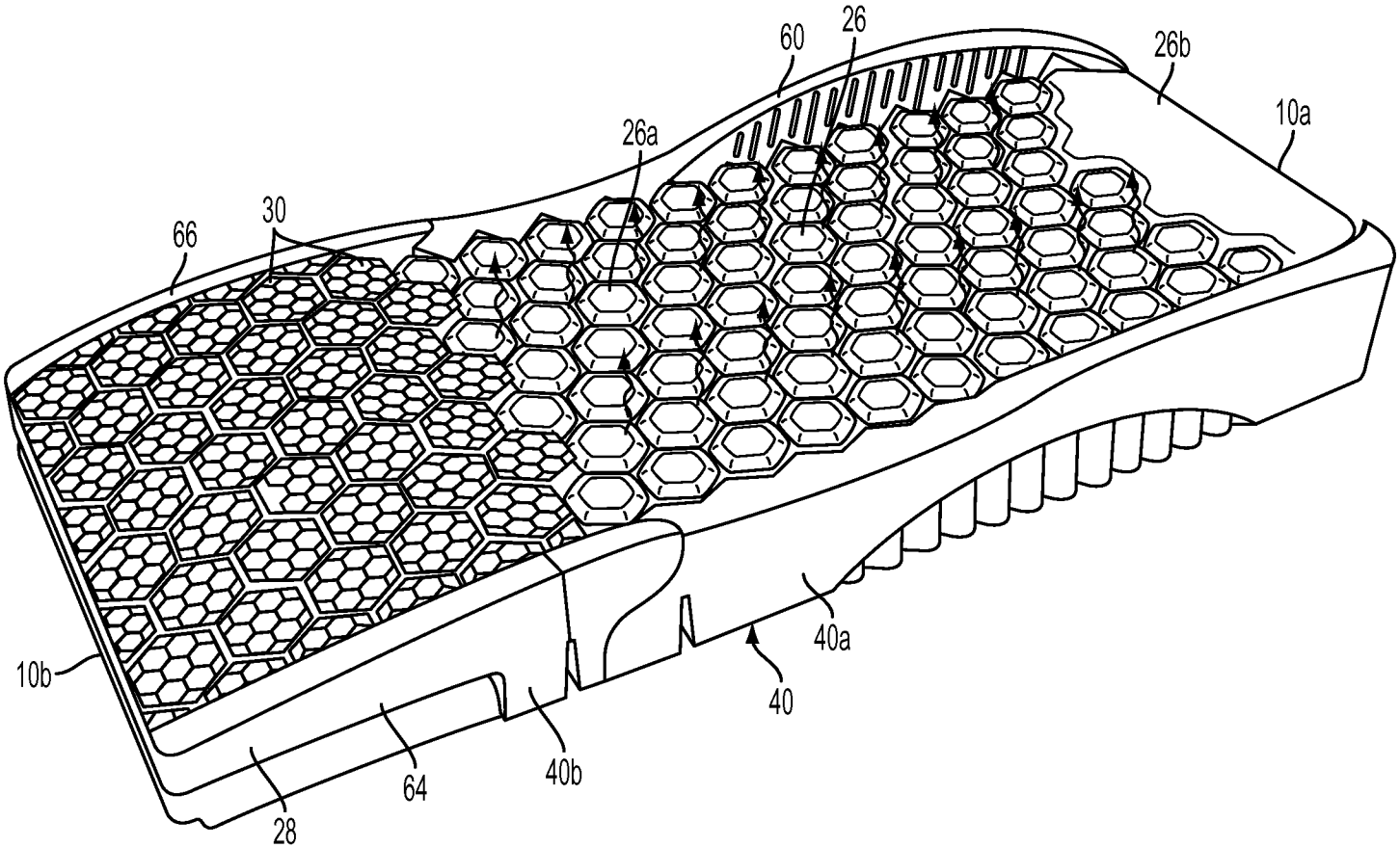
FIG. 3 is a similar view to FIG. 2 with the cover removed to show the internal cushioning layers.
Figure 3A:
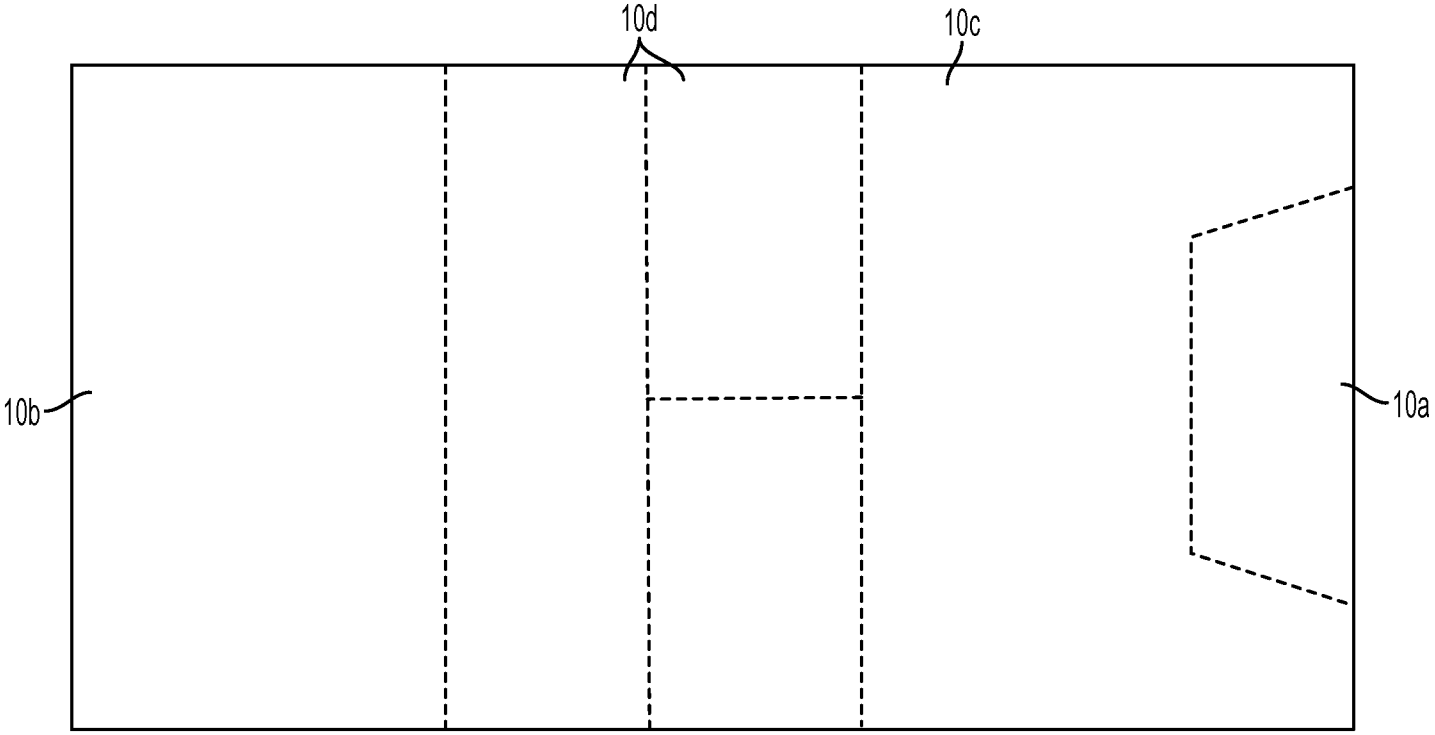
FIG. 3A is a plan view of the patient support illustrating the different areas or zones of the patient support.
Figure 4:
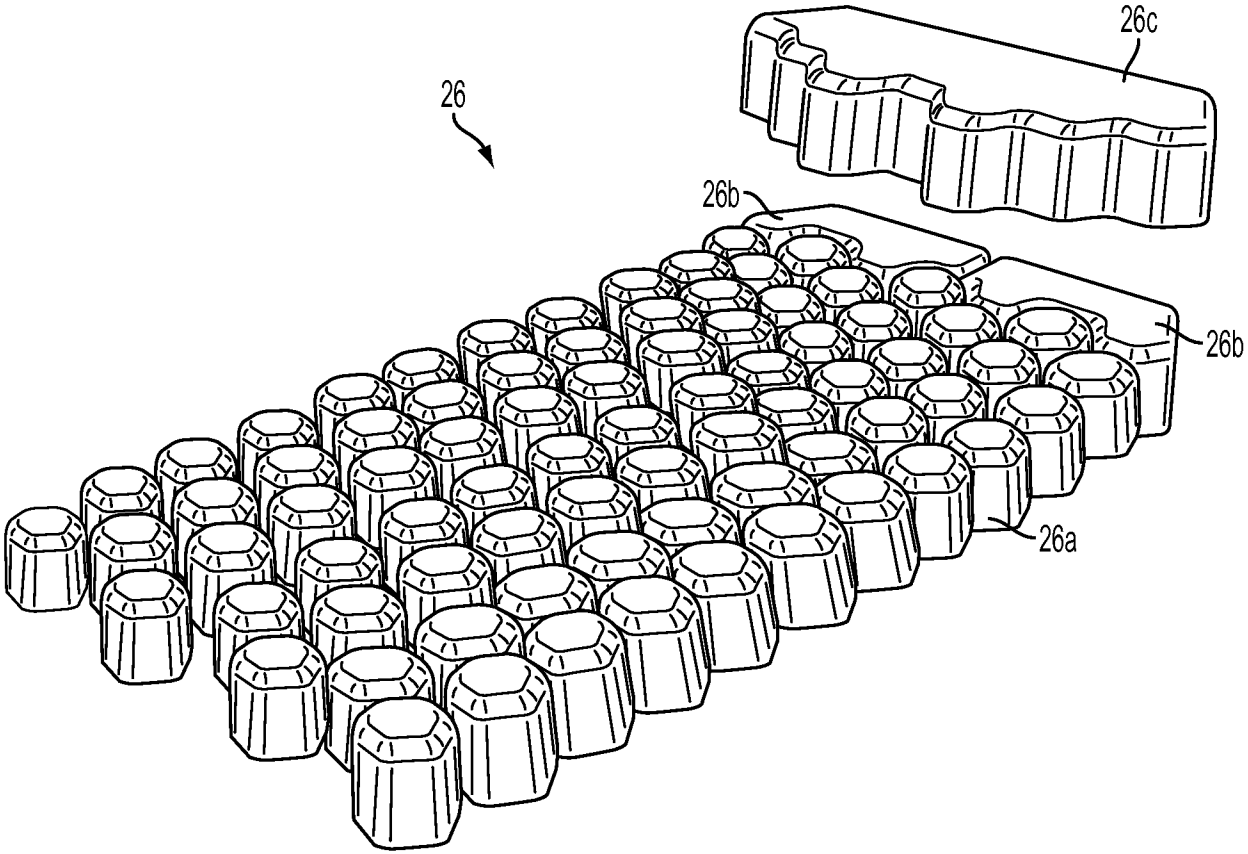
FIG. 4 is a perspective view of the bladder layer of the patient support.
Figure 4A:
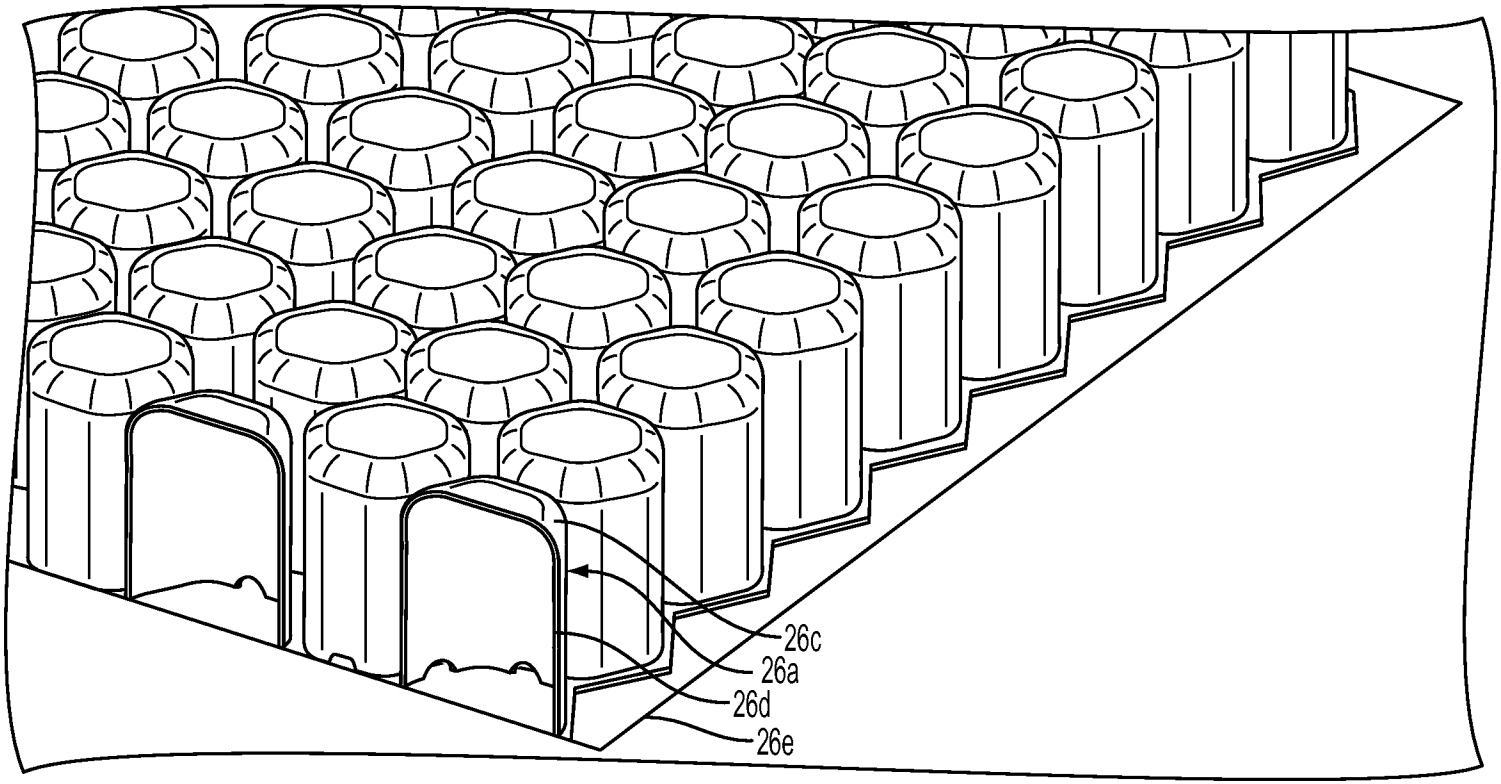
FIG. 4A is a perspective view of the bladder layer with a partial cut-away illustrating the construction of at least some of the bladders.

Referring to FIGS. 3 and 4, bladders 26*a* are arranged in rows and columns (rows are transverse to the long axis of the patient support, with columns extending generally parallel to the long axis of the patient support), with each bladder 26*a* in each row offset longitudinally from the adjacent bladder 26*a* to form an alternating pattern in each row so that the bladders are nested with the bladders of the adjacent rows. Further, the lateral center line of each bladder 26*a* extends between its respective adjacent bladders. In the illustrated embodiment, bladders 26*a* each have a hexagonal cross-section so that each bladder edge is offset from the corresponding edge of the adjacent bladder. For further details of the bladder arrangement, materials, and construction, reference is made to copending U.S. patent application Ser. No. 13/022,326, filed Feb. 7, 2011, entitled PATIENT/INVALID HANDLING SUPPORT; Ser. No. 13/022,372, filed Feb. 7, 2011, entitled PATIENT/INVALID HANDLING SUPPORT; Ser. No. 13/022,382, filed Feb. 7, 2011, entitled PATIENT/INVALID HANDLING SUPPORT; Ser. No. 13/022,454, filed Feb. 7, 2011, entitled PATIENT/INVALID HANDLING SUPPORT; Ser. No. 13/548,591, filed Jul. 13, 2012, entitled PATIENT/INVALID HANDLING SUPPORT, all of which are incorporated by reference herein in their entireties.

Referring again to FIGS. 3 and 4, head section bladders 26*b* have a generally block-shaped configuration with the side of bladders 26*b* facing bladders 26*a* having recesses that correspond to the shape of bladders 26*a* to provide a smooth transition between the head end and back section bladders. Bladders 26*b* may also incorporate a cover 26*f* to tie both left side head end bladder and right side head end bladder together to provide uniform support to the patient's head except when the patient is being turned, as described below.

Gel layer 28 is formed from a gelastic material. Suitable gelastic materials include a SEB, SEBS, SEP, SEPS, SEEP, SEEPS polymer combined with a mineral oil, such as disclosed in U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,865,759; 7,060,213; 6,413,458; 7,730,566; and 7,964,664, which are all incorporated herein by reference in their entireties.

As one example, the gelatinous elastomeric material may be formulated with a weight ratio of oil to polymer of approximately 3.1 to 1. The polymer may be Kraton 1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated with a weight ratio of oil to copolymers of approximately 2.6 to 1. The copolymers may be Septon 4055 and 4044 which are available from Kuraray America, Inc., which has a place of business in Houston, Tex., or it may be other copolymers. If Septon 4055 and 4044 are used, the weight ratio may be approximately 2.3 to 1 of Septon 4055 to Septon 4044. The oil may be mineral oil and one or more stabilizers may also be used. Additional ingredients—such as, but not limited to—dye may also be added. In addition to these two examples, as well as those disclosed in the aforementioned patents, still other formulations may be used.

Figure 9:
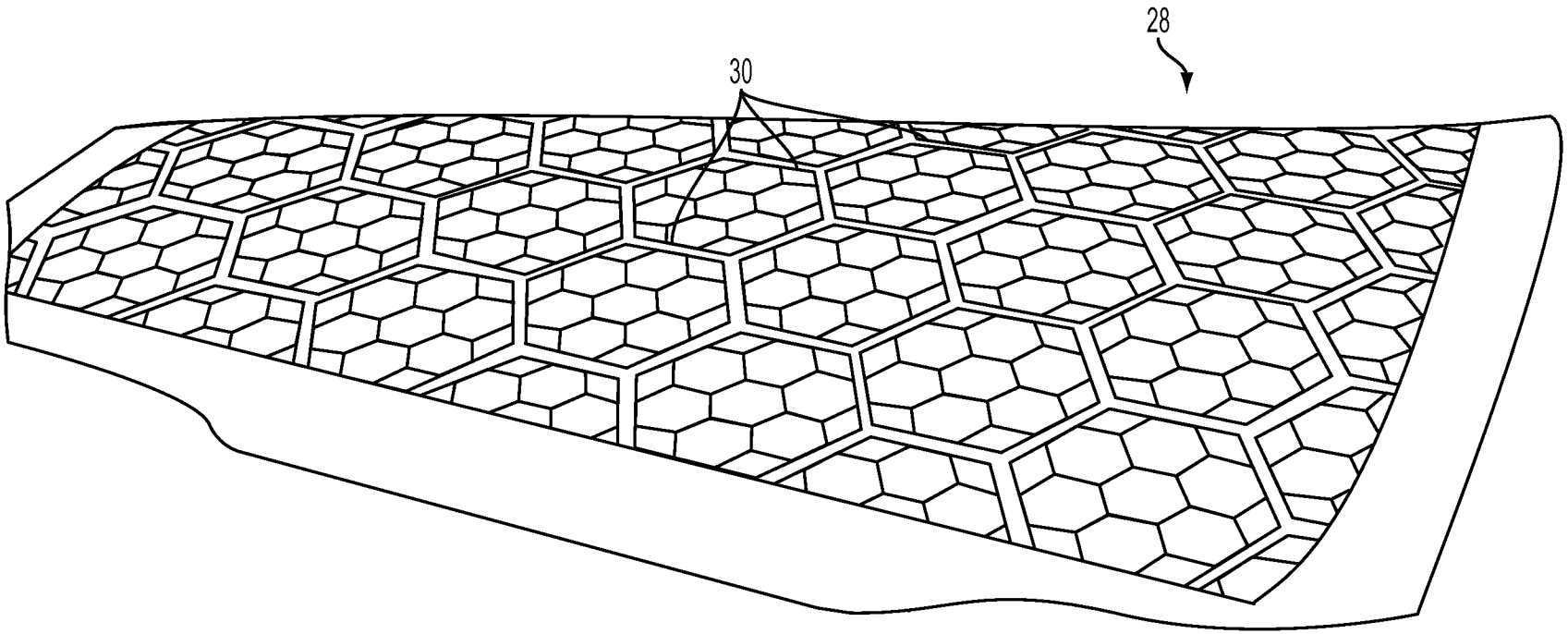
FIG. 9 is a perspective view of the gel layer of the patient support.
Figure 9A:
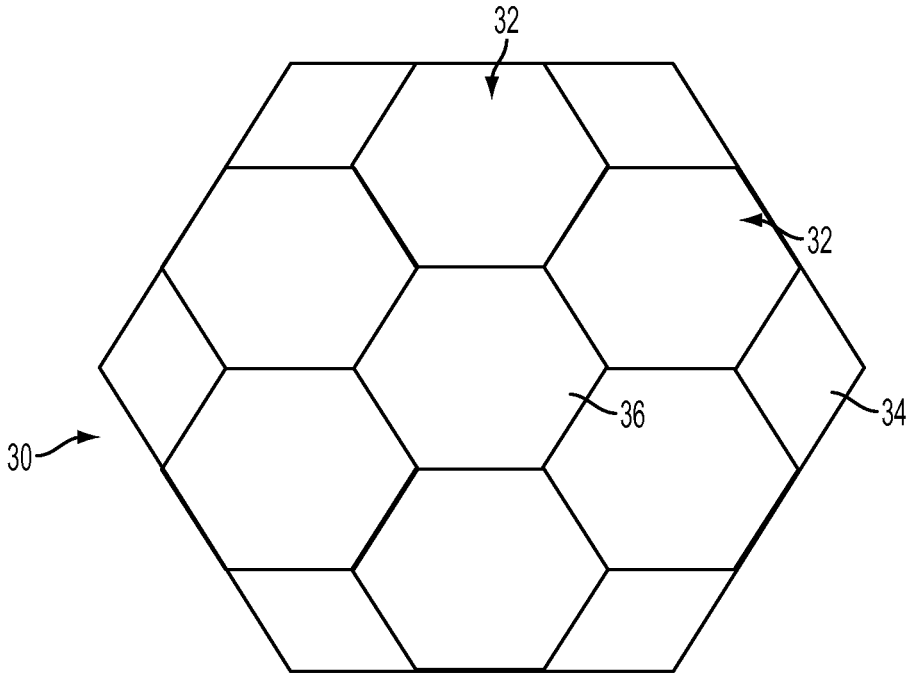
FIG. 9A is an enlarged plan view of a gel footing of the gel layer of FIG. 9.

In the illustrated embodiment, gel layer 28 includes a plurality of gelastic footings 29 that are disconnected from each other so that each footing can compress independently from its adjacent surrounding footing. The term footing is used in the sense that the overall gel structure (defined by outer perimeter wall 30) is wider than it is tall. Referring to FIG. 9A, each footing 29 is formed by an outer perimeter wall 30, having a generally hexagonal shape, which is then supported internally by six internal hexagonal-shaped walls 32, which are arranged in a circular pattern to form a central hexagonal-shaped wall 36. Central hexagonal-shaped wall 36 is formed by the respective inner walls of the six internal hexagonal-shaped walls 32, which in turn share walls with the outer perimeter wall 30 and form six diamond shaped walls 34 therebetween. In other words, the central hexagonal-shaped wall 36 is not a separate wall and instead is defined by the inwardly facing walls of each internal hexagonal-shaped wall 32. Similarly, the outer wall of each internal hexagonal-shaped wall 32 is provided or formed by a portion of the outer perimeter wall 30.

For example, the height of each wall may be in a range of about 1" to 4", or in a range of about 2" to 3", and the thickness of each wall may be in a range of about 1/32" to 3/8" or in a range of about 1/16" to/1/4". The width of each footing may be in a range of about 3" to 6" or in a range of about 4" to 5", with each internal hexagonal-shaped wall in a range of about 1" to 2" or in a range of about 3/4 to 1 1/2". To facilitate injection molding, the walls are slightly tapered, for example, to create a draft angle. For example, the draft angle may fall in a range of about 1 degrees to 10 degrees or in a range of about 3 degrees to 8 degrees In this manner, each gel footing 30 provides a nested set of interconnected gel walls that tend to buckle under the weight of a patient and continue to provide cushioning support to the patient's heels over the full range of collapse of each group of the internal walls. By spreading the load across multiple walls that are interconnected but arranged in isolated groups, each grouping will allow greater immersion and provide better redistribution of stress or pressure across the patient's heel then when all the walls are tied together.

In addition, each gel wall of each gel footing may be joined at their lowermost edges by a base sheet of gel, which is relatively thin, like a skin, which is used in the molding process to help distribute the gel material across the full width of the gel layer.

Further, the gel forming gel layer 28 may be selected to very soft, but with the interconnection of the adjacent inner walls still provide adequate support and cushioning to the patient's heel. For examples of other gel configurations that may be used, including gel columns (where the gel structures have a greater height than their width), reference is again made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149, 736; 5,331,036; 5,881,409; 5,994,450; 5,749,111; 6,026,527; 6,197,099; 6,843,873; 6,865,759; 7,060,213; 6,413,458; 7,730,566; 7,823,233; 7,827,636; 7,823,234; and 7,964,664, which are all incorporated herein by reference in their entireties.

As best seen in FIG. 3, bladder layer 26 and gel layer 28 are supported by a foam crib 40. Crib 40 optionally includes a first portion 40*a* that extends under bladder layer 26 from the head end to the thigh region of the patient and a second portion 40*b* that extends under the gel layer from below the thigh region to foot end 10*b* of patient support 10. Crib 40 tends to keep the softer cushion layers of the bladders and gel in place while also providing a firmer rail along both sides of support 10.

Figure 5:
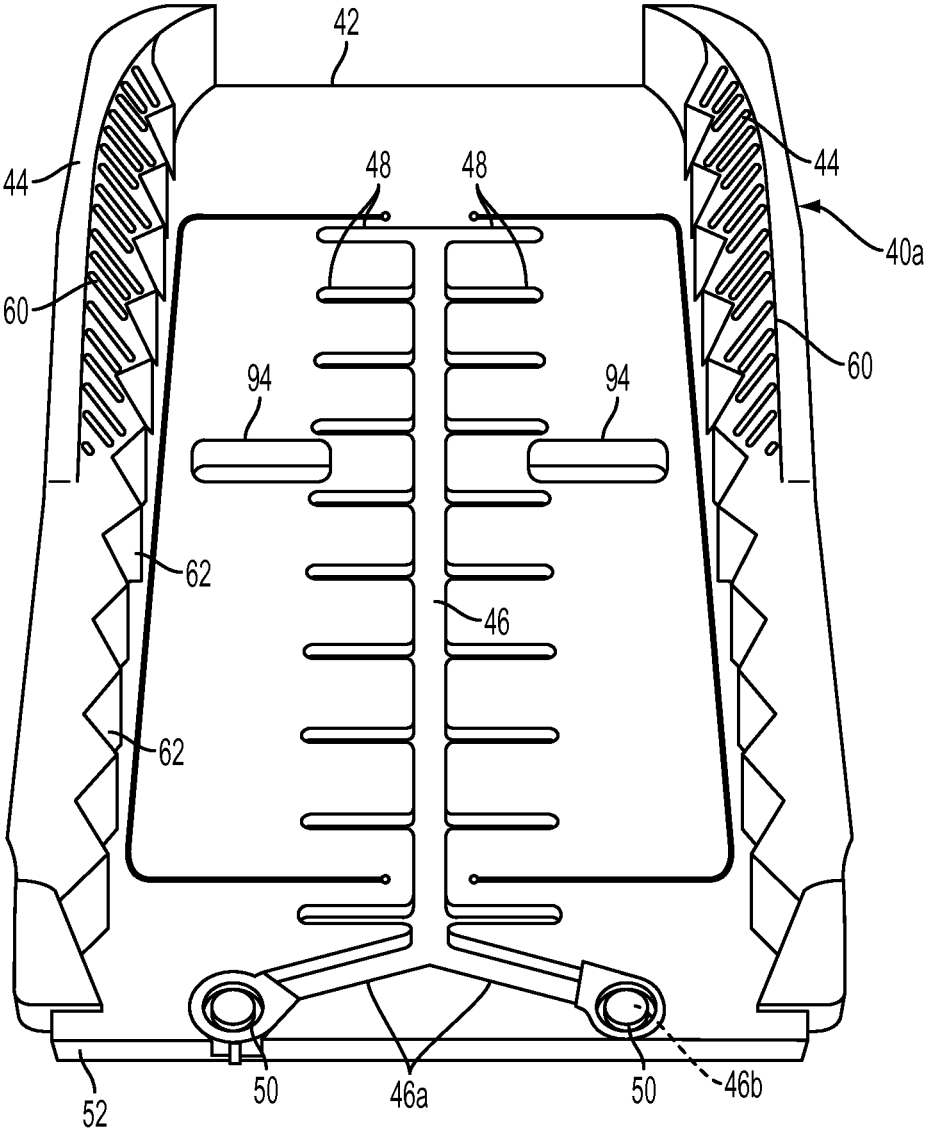
FIG. 5 is a perspective view of the foam crib that supports the bladder layer.
Figure 6:
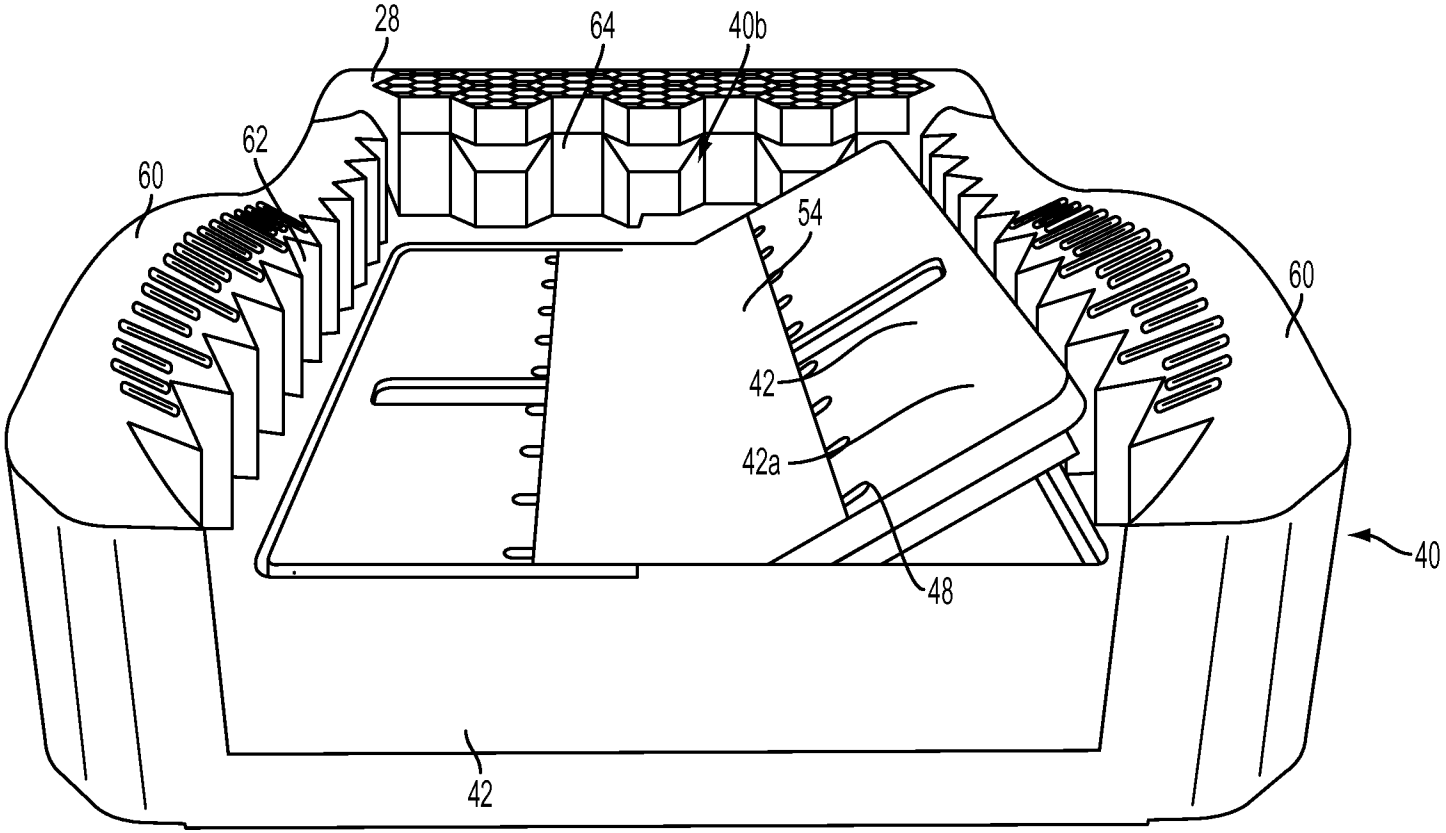
FIG. 6 is a bottom perspective view the foam crib of FIG. 5 illustrating the foam crib with a hinged panel.

Foam crib portion 40*a* includes a base wall 42 and a pair of upwardly extending sidewalls 44, which as noted form a foam rail along opposed sides of bladder layer 26 to facilitate entry to and exit from the bed, and to cradle the patient when they are in the supine position. Referring to FIGS. 5 and 6, base wall 42 of crib 40 includes a plurality of channels that form a tree-like configuration with a central channel 46 and a plurality of laterally extending branch channels 48, which are in fluid communication with central channel 46. Central channels 46 in fluid communication with inlet or feeder channels 46*a* formed at the base of central channel 46. And, each inlet channel 46*a* includes a recess 46*b* for receiving a blower unit 50, whose output is directed toward the central channel 46 through inlet or feeder channel 46*a* and whose intake extends through the lower edge of base wall 42 so that when blower units 50 are covered by bladder layer 26, the blower units can draw in air from the space adjacent the lower end of foam crib 40, as will be more fully described below. These channels also facilitate the bending of foam crib, described below.

Figure 4B:
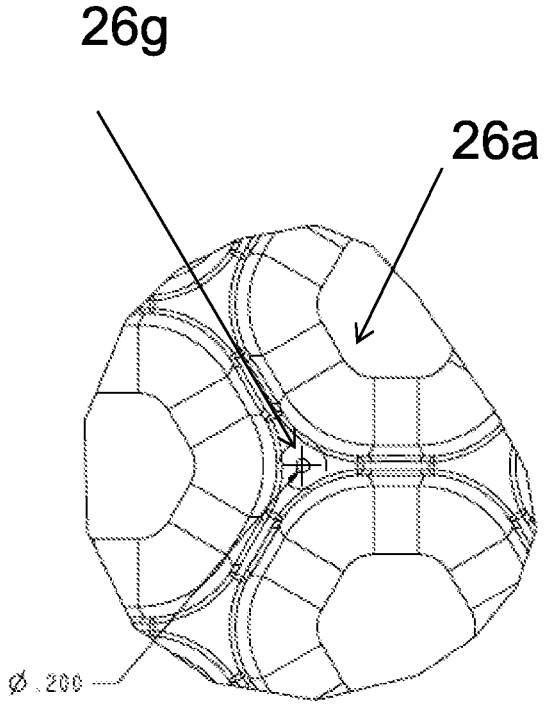
FIG. 4B is an enlarged top perspective view of a portion of the bladder layer of the patient support.

Blower units 50, when operated, blow air into channels 46*a* and 46, which in turn distribute the air into branch channels 48 to generate air flow into the bladder layer 26 from beneath. To allow the air to flow through bladder layer 26, the base sheet 26*e* of bladder layer 26 includes a plurality of openings 26*g* (FIG. 4B) so that air can flow up through the bladder layer 26 and between the bladders 26*a* as indicated by the arrows in FIG. 3. To better focus the flow of air, base layer 42 may incorporate a sheet of non-woven material 54 (FIGS. 2A and 6) adhered to its surface, which extends over inlet channels 46*a*, central channel 46, and portion of branch channels 48 to leave the distal end of each branch channel open so that they can direct air into the bladder layer 26 at discrete space locations.

Referring again to FIG. 5, each sidewall 44 of crib 40 has an upper wedge-shaped portion 60 adjacent at least the shoulder area of a patient supported on patient support 10. Wedge-shaped portions 60 form angled surfaces facing the patient, at the patient's shoulder region, which extend above the upper surface of bladder layer 26 when inflated and unloaded, and extend above bladder layer 26 at an even greater height when a patient is placed on bladder layer 26. Therefore, wedge-shaped portions 60 provide lateral support to a patient at their shoulders, but are sufficiently resilient to collapse down to the underlying base of sidewall 44 when a patient exits the bed.

Inwardly facing sides of sidewalls 44 optionally include a plurality of recesses 62 that at least generally follow the contour of each adjacent bladder 26*a* to thereby provide lateral support to each adjacent bladder both in the lateral and longitudinal direction. As a result, bladders 26*a* are held in place and, to a certain extent, somewhat interlocked with each other given their own interlocking arrangement. Similarly, as seen in FIG. 3, the inwardly facing edge of gel layer 28 may include a plurality of recesses to receive the bladders adjacent the gel layer so that the foot end bladders are similarly laterally and longitudinally supported by the adjacent gel layer.

As best seen in FIG. 6, foam crib portion 40*b* similarly has a base wall 64 with a pair of upwardly extending sidewalls 66 that similarly include recesses that generally match the shape of the respective gel footings and recesses formed between each gel footing. In a similar manner to the bladders, sidewalls 66 therefore provide lateral and longitudinal support to each of the adjacent gel footings that run along the edge of the gel layer 28. In this manner, each layer is interlocked with its adjacent layer so that all three materials (foam, air-filled bladder, and gel) form a cushioning system.

Further, foam base wall 66 of foam crib section 40*b* includes a plurality of recesses to receive the lower ends of each bladder at the foot end of bladder layer 26 and, further, provide downwardly tapered upper surfaces adjacent each recess so that the gel footings at the thigh end of gel layer 28 are sloped downwardly to provide a smooth transition between the adjacent gel layer and bladder layer. This transition is optionally aligned generally between the knee and thigh of the patient supported on patient support 10.

Figure 2A:
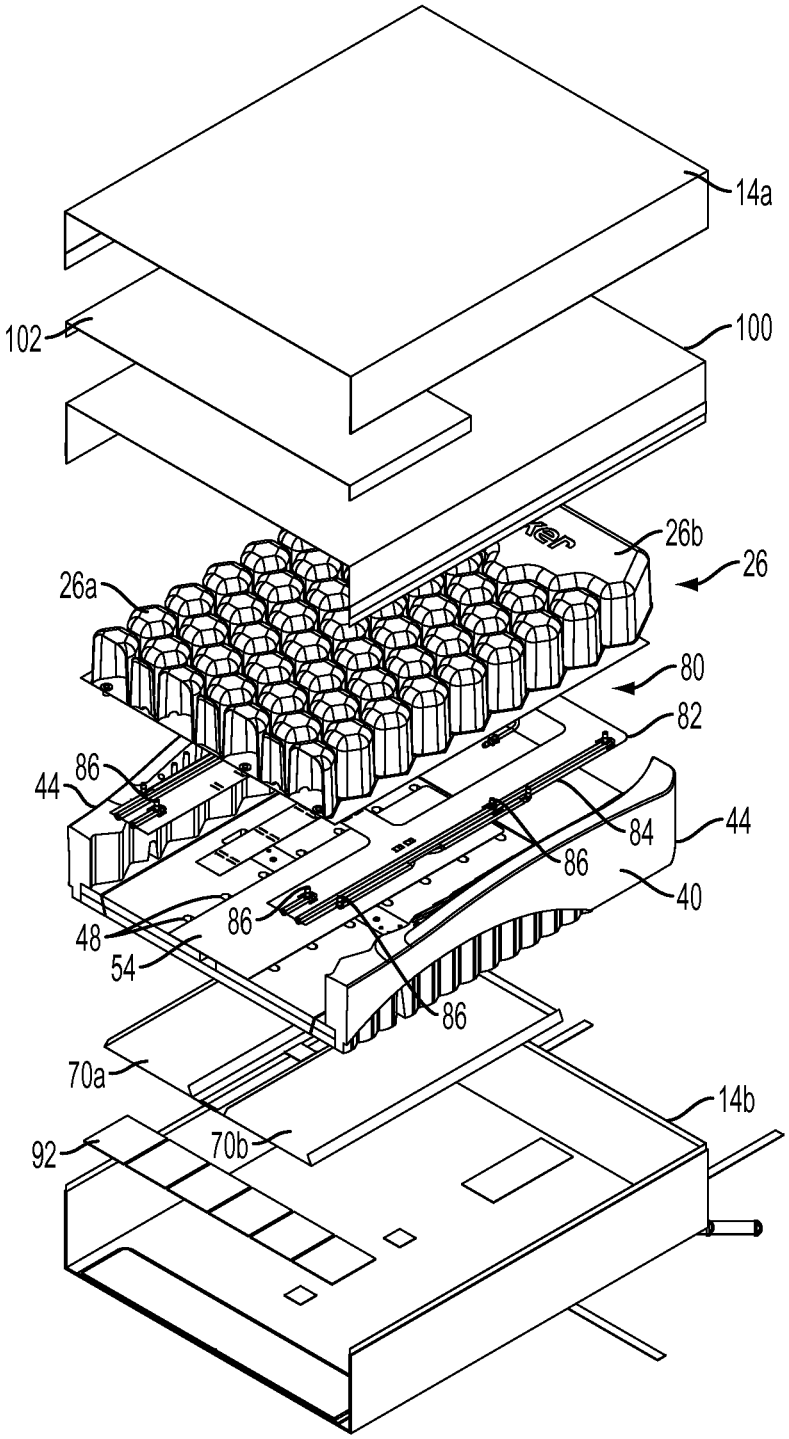
FIG. 2A is an exploded fragmentary view of the patient support illustrating the various cushioning layers and components that may be incorporated into the patient support.

As best seen in FIG. 2A, patient support 10 optionally includes a pair of turning bladders 70*a* and 70*b*. Turning bladders 70*a*, 70*b* are positioned beneath crib 40. Referring to FIG. 5, bladders 70*a* and 70*b* are aligned under sectioned portions 42*a* and 42*b* of base wall 42 of crib 40, which are detached from the remainder of the crib along three sides to form hinged panels, which are hinged at the center of crib 40 so that they can lift up when one of the turning bladders is inflated. To prevent the hinged panel from falling into the crib, each panel optionally includes an L-shaped rim that generally aligns with a corresponding L-shaped sill in the balance of the crib that extends around the detached panels.

To deliver air to bladders 26*a* and 26*b* and to turning bladders 70*a* and 70*b*, support 10 includes a pneumatic system. In this illustrated embodiment, the pneumatic system includes a pneumatic harness 80, which includes a plurality of tubing sections 84 that are supported and secured to a fabric carrier that secures the various tubing sections and associated connectors 86 in their desired configuration and locations. In this manner, when harness 80 is placed over crib 40, the tubing and its associated connectors can be easily aligned with the appropriate inlets for inflating the respective bladders. Together, the tubing and fabric carrier form a flexible manifold that can be easily located in a position with an inlet end (where the tubing exits the carrier) positioned and aligned for coupling to the pump or pumps that supply the air to the respective bladders. The pump or pumps that supply air to the tubing are optionally located in a box at the foot end of the support, more fully described below.

Figure 7:
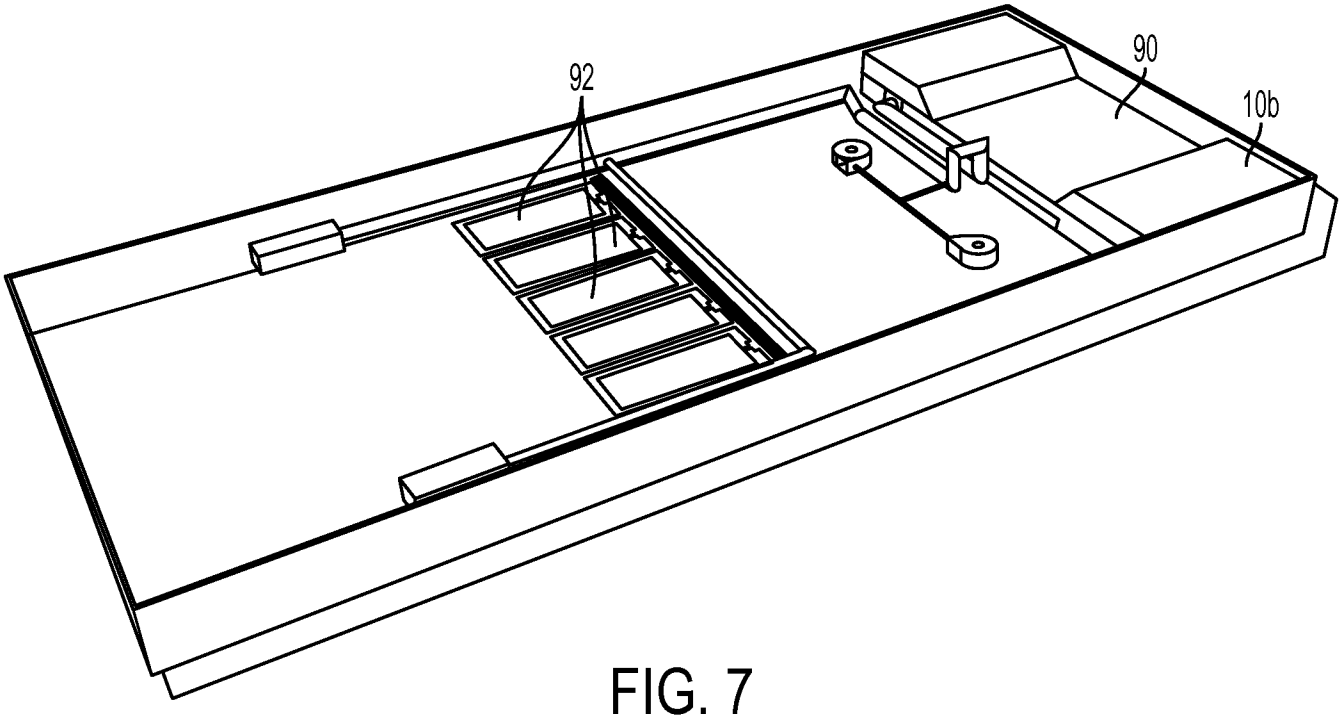
FIG. 7 is a perspective view of the base of the patient support.
Figure 8:
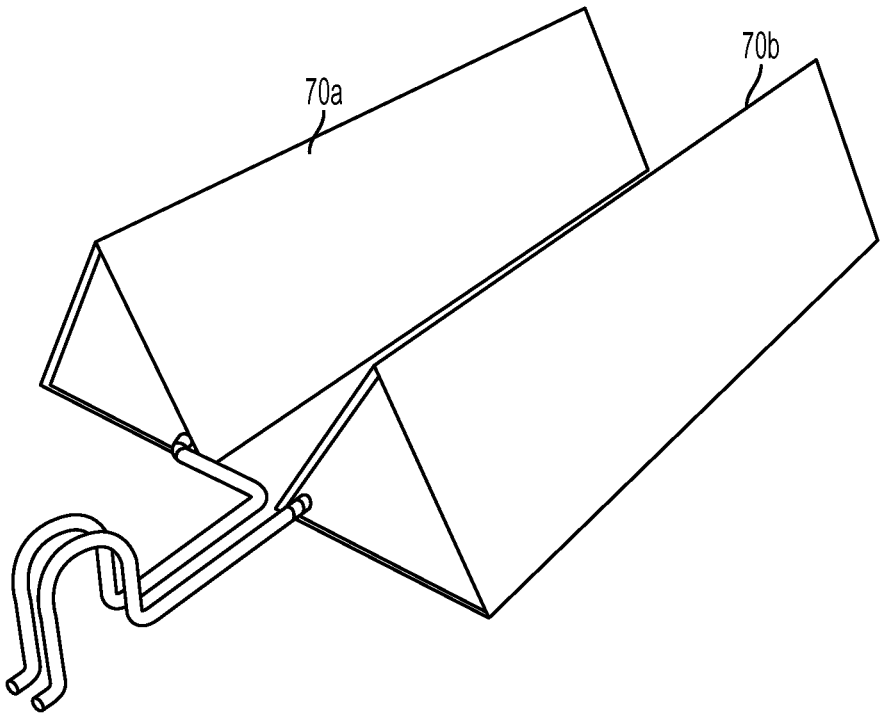
FIG. 8 is a perspective view of a pair of turning bladders.

As noted above, the various tubing that supplies the bladders with air are coupled to a pump or pumps, which in the illustrated embodiment are located in a pump box 90 shown in FIG. 7. Pump box 90 is preferably located at the foot end 10*b* of the patient support 10 and further beneath the crib portion 40*b* under gel layer 28. Pump box 90 for example may be formed from a polymeric material and has a centrally located recess typically located under the heels of a patient to provide increased immersion depth for the heels of the patient when the patient is lying on patient support 10. In addition to storing or holding the pump or pumps, pump box 90 may also include a CPR manifold, which when opened allows the air from the bladders to be dumped so that the patient is then supported directly on the crib beneath the bladders, which provides a firmer surface to allow CPR to be administered to the patient. In addition to a pump or pumps, box 90 may also house various controls and circuitry for controlling the pump or pumps and for other devices that may be incorporated into patient support.

As noted above, bladders 26*a*, 26*b* are inflated, or deflated, in groups or zones as described above under the control of box 90 and its associated pumps and control circuitry. The fluid connections between the bladders and box 90 are established by the tubing 84 that run between box 90 and the various bladders and which connect to inlets on the bladders by connectors 86. As noted above, tubing 84 is attached to housed in a fabric carrier which together form the flexible manifold 80.

Similarly, manifold 80 may support the tubing for turning bladders 70*a*, 70*b*, which extend generally longitudinally in a direction from the head end 10*a* to foot end 10*b*, and as noted are positioned underneath foam crib 40 and are used to help turn a patient positioned on top of patient support 10. To that end, turn bladders and are each separately and independently inflatable and deflatable, which is also controlled by box 90 and its associated circuitry.

For example, as discussed in reference to copending application U.S. Ser. No. 61/696,819, filed Sep. 5, 2012, entitled INFLATABLE MATTRESS AND CONTROL METHODS, patient support 10 may incorporate sensors, such as depth sensor plates 92, for sensing the immersion of a patient into the surface. Based on the sensed immersion, the controller, which also may be located in box 90 or elsewhere, including for example in recesses 94 formed in foam crib 40 (FIG. 5), may be used to optimize the immersion of a patient into the surface based on the individual needs of a patient. In order to assist depth sensor plates 92, support 10 incorporates a conductive fabric 102, which together function as capacitive sensors whose output changes as a patient moves closer or farther away from them. More specifically, conductive fabric 102 functions in a manner similar to the top plate of a parallel plate capacitor, while depth sensor plates 92 form the bottom plates of the parallel plate capacitor. Thus, as the vertical distance between conductive fabric 102 and any of the depth sensor plates 92 changes, the capacitance between the fabric 102 and the plate(s) 92 will change. This change is detected by a detector circuit that is electrically coupled between fabric 102 and each of the depth sensor plates 92. That is, one or more wires (not shown) are electrically coupled to fabric 102 and the detector circuits, while one or more other wires (not shown) are connected between each plate 92 and the detector circuit. Conductive fabric 102 may be any commercially available fabric that is electrically conductive, or it may be an electrically conductive foil, or any other material that is electrically conductive, and that is flexible enough to not significantly alter the flexibility of patient support 10 in that region.

Fabric 102 is positioned on top of bladder layer 26 but over a fire sock or barrier 100, which wraps around bladder layer 26 and is made of any suitable material that resists the spread of fire. Such materials may vary. In one embodiment, fire barrier 100 may be made of, or include, Kevlar® (poly-paraphenylene terephthalamide), or other brands of para-aramid synthetic fibers. Other materials may alternatively be used. Cover 14, which includes an upper cover portion 14*a* and a lower cover portion 14*b*, therefore encloses fabric 102, sock 100, bladder layer 26, gel layer 28, crib 40, turning bladders 70*a*, 70*b*, and plates 92, as well as pump box 90 and the pneumatic manifold. For example, upper cover portion 14*a* and a lower cover portion 14*b* may be secured together by a zipper, which allows access to the various components inside support 10.

As noted above, when one of the turning bladders is inflated, the corresponding hinged panel of foam crib will raise up. At the same time, the air in the bladders above the rising panel may either be maintained or increased, while the pressure on the bladders on the opposite side may be reduced or even deflated.

In addition to turning a patient, sections of patient support 10 may be folded to accommodate the Fowler being raised or the leg section of being lowered. For example, support 10 may be supported on a bed with an articulating deck, with a head section, a back section, a seat section and a leg section, with one or more sections being pivotable to raise the Fowler or leg sections as noted. To accommodate the articulating deck, foam crib may include a corresponding gatch for each point of articulation (see FIG. 3). Further, cover 14 may include a V-shaped section (no shown) which extends into its underside and into one of the gatches to similarly accommodate the bending of support when one of the deck sections is pivoted. For example, the open mesh that was noted above may be located in the V-shaped section to allow air to be drawn into the cover when blower units are running to circulate air through the cover. Though it should be understood that the mesh panel may also be located elsewhere, including on a bottom side of cover 14.

When assembled, therefore, patient support 10 not only includes a cushioning layer that provides a pressure redistribution system to enhance the support of a patient lying upon support 10 but also optionally provides a moisture management system, as well as an immersion control system. As noted above, additional functionalities may be provided in a form of configuring some of the bladders as percussion and/or vibration bladders, such as described in the referenced copending applications It should be understood that patient support 10 may be modified to include one or more bladders in the foot zone in lieu of the gel layer and, therefore, the air pressure inside of these bladders could be monitored and controlled by the same system that controls the feet section bladders, thigh and seat section bladders, and head section bladders.

Figure 10:
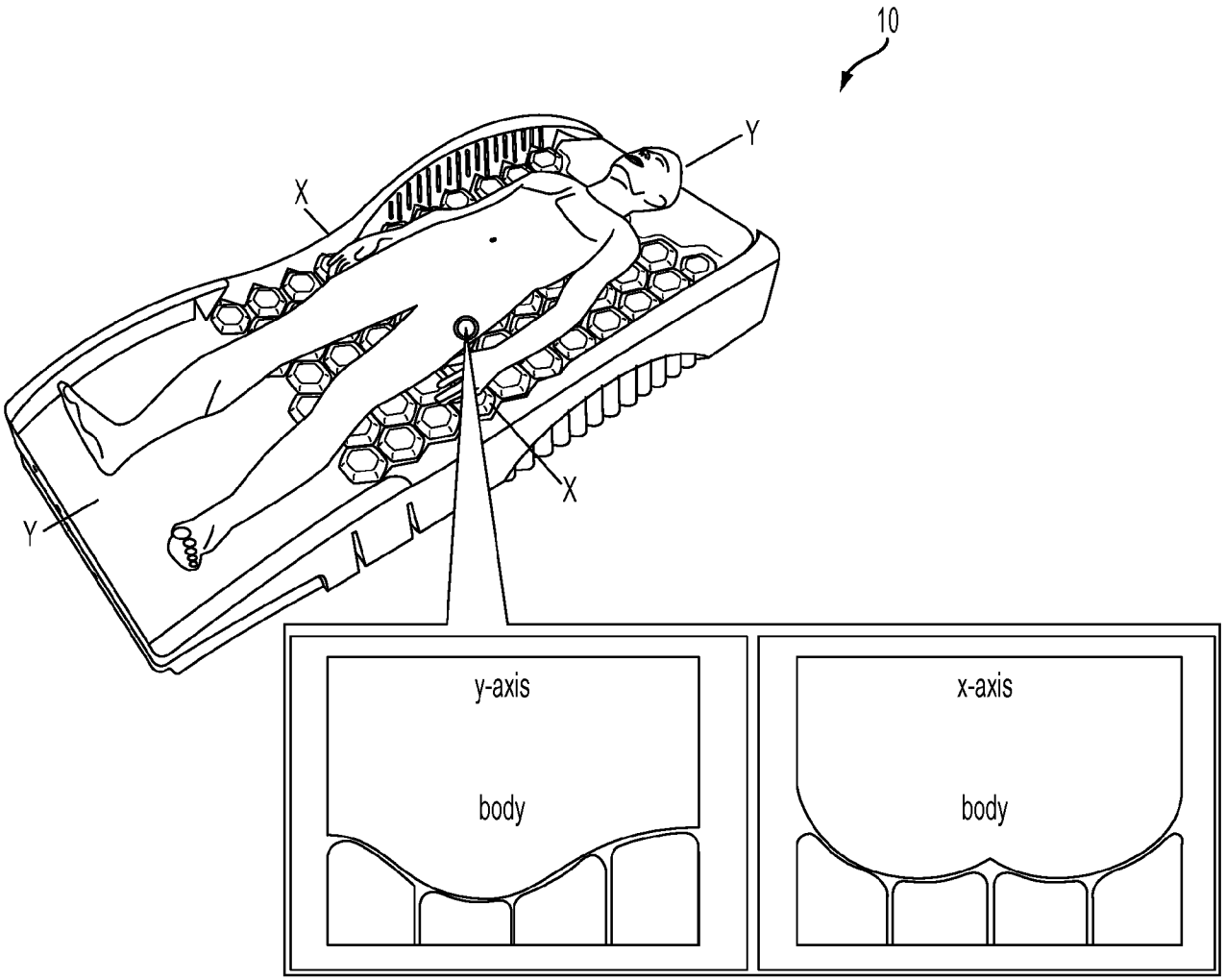
FIG. 10 is a similar view to FIG. 3 illustrating a patient supported on the surface and illustrating the immersion of the patient's body into the surface.

Accordingly, the present invention provides a patient support that provides a mattress with inflatable support bladders that offer improved immersion of the patient into the surface of the mattress and, therefore, improved pressure distribution to the patient. With the independent discrete bladder arrangement, it has been found that a more balance contact (see FIG. 10) can achieve in both the x and y-axes. Further, given the unitary nature of the support bladders, the need for tubing can be significantly reduced, and for some functions eliminated.

While several forms of the invention have been shown and described, other changes and modifications will be appreciated by those skilled in the relevant art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A patient support comprising:

a plurality of cushioning layers arranged such that their supporting surfaces when unloaded are generally arranged in a plane, each cushioning layer interlocked with each adjacent cushioning layer wherein each cushioning layer provides lateral and longitudinal support to each of its adjacent cushioning layer; and said cushioning layers comprising a plurality of inflatable bladders and a gel layer adjacent said inflatable bladders, said gel layer interlocking with adjacent bladders of said inflatable bladders, each of said inflatable bladders having a hexagonal cross-section, said gel layer including a plurality of hexagonal gel footings, and each of said gel footings being disconnected from its adjacent gel footings, wherein each of said gel footings is internally reinforced by a plurality of hexagonal gel wall structures.

2. The support of claim 1, wherein said cushioning layers are supported on a foam crib.

3. The support of claim 2, further comprising turning bladders positioned below said foam crib.

4. The support of claim 3, wherein said foam crib includes at least two hinged panels above said turning bladders to allow turning of a patient supported on said patient support.

5. The support of claim 2, wherein said foam crib includes a plurality of channels extending there through for directing air through said foam crib and into at least one of said cushioning layers.

6. The support of claim 5, wherein said foam crib includes a base wall, said base wall having said channels, and said channels comprising a central channel and a plurality of branch channels in communication with said central channel for directing air flow.

7. The support of claim 5, wherein said foam crib include a recess in communication with said channels and a blower supported in said recess for directing air into said channels.

8. The support of claim 7, wherein said inflatable bladders form a bladder layer, said bladder layer supported on said foam crib, said bladder layer having a base sheet and an upper sheet forming said plurality of inflatable bladders, said bladder layer having a plurality of transverse openings through said base sheet, and said channels for directing air flow through said openings.

9. The patient support according to claim 2 wherein said foam crib has a base wall supporting said cushioning layer and opposed side walls extending upwardly from said base wall, and said side walls including wedge-shaped portions forming inwardly facing angled surfaces for facing a patient supported on said cushioning layer.

10. The patient support according to claim 9, wherein said cushioning layer had an upper surface, said wedge-shaped portions extending above said upper surface of said cushioning layer when unloaded.

11. The patient support according to claim 10, wherein said wedge-shaped portions have a cross-section that imparts sufficient resilience to collapse down when a patient supported on the cushioning layer exits the bed.

12. The patient support according to claim 1, wherein each of said cushioning layers forms a patient supporting surface for supporting a patient thereon.

13. The support of claim 1, wherein at least one of the cushioning layers includes transverse openings allowing air to pass through the at least one cushioning layer to direct air flow through the at least one cushioning layer.

* * * * *